United States Patent [19]

Drummond, III

[11] Patent Number: 4,899,553

[45] Date of Patent: Feb. 13, 1990

[54] COOLING DEVICE FOR BEVERAGE CONTAINERS

[76] Inventor: Charles S. Drummond, III, 8 Berkshire Dr., Richmond, Va. 23229

[21] Appl. No.: 366,621

[22] Filed: Jun. 16, 1989

Related U.S. Application Data

[60] Continuation-in-part of Ser. No. 302,369, Jan. 27, 1989, which is a division of Ser. No. 186,066, Apr. 25, 1988, Pat. No. 4,821,525, which is a continuation-in-part of Ser. No. 92,178, Aug. 21, 1987, abandoned, which is a continuation-in-part of Ser. No. 11,199, Feb. 5, 1987, abandoned.

[51] Int. Cl.[4] ..... F25D 3/08

[52] U.S. Cl. ..... 62/372; 62/457.5; 62/530

[58] Field of Search ..... 62/371, 372, 1, 457.5, 62/529, 530; 249/60, 64, 120, 139, 176, 203; 264/28

[56] References Cited

U.S. PATENT DOCUMENTS

| | | | |
|---|---|---|---|
| 2,537,915 | 1/1951 | Roop | 62/1 X |
| 2,629,515 | 2/1953 | Asplund | 62/371 X |
| 2,952,133 | 9/1960 | Miller | 62/457 X |
| 3,482,326 | 12/1969 | Brewster | 249/176 X |
| 3,974,658 | 8/1976 | Starrett | 62/457.5 |
| 4,543,801 | 10/1985 | Damiens | 62/457.5 |
| 4,550,575 | 11/1985 | DeGaynor | 62/1 X |
| 4,580,412 | 4/1986 | Wells | 62/372 |
| 4,625,518 | 12/1986 | Freedman | 62/1 |

*Primary Examiner*—Lloyd L. King
*Attorney, Agent, or Firm*—Larson and Taylor

[57] ABSTRACT

Cooling arrangements are provided for cooling beverage containers of a multi-container package. In one embodiment, a cooling device consists solely of a shaped, generally planar slab of ice including a surface for directly engaging and supporting the bottoms of the beverage containers of the package. This surface includes a plurality of recesses therein in which the bottoms of the beverage containers are received. The device is carried in a plastic bag, and an elevating member positioned therebeneath defines a space in which water from the melting ice can collect. In another embodiment, the upper surface of a shaped slab of ice defines a pair of inclined planes which slant down from a central region and which include semi-cylindrical recesses therein in which the sides of beverage containers are received. In a further embodiment, a cooling receptacle is formed by freezing a slab of ice within a bag, the slab of ice having incorporated therein a plurality of gripping loops for holding the containers in contact with the surface of the ice slab and an anchoring arrangement embedded in the ice slab for supporting the gripping loops in spaced relation to the slab.

6 Claims, 3 Drawing Sheets

COOLING DEVICE FOR BEVERAGE CONTAINERS

CROSS REFERENCES TO RELATED APPLICATIONS:

This application, is a continuation-in-part of U.S. Ser. No. 07/302,369, pending filed on Jan. 27, 1989, which is a divisional of U.S. Ser. No. 07/186,066, filed on Apr. 25, 1988, now U.S. Pat. No. 4,821,525 is, in turn, a continuation-in-part of U.S. Ser. No. 07/092,178, filed on Aug. 21, 1987, now abandoned, which is, in turn, a continuation-in-part of U.S. Ser. No. 07/011,199 filed on Feb. 5, 1987 and now abandoned.

FIELD OF THE INVENTION

The present invention relates to cooling devices for beverage containers and more particularly, to cooling devices which provide efficient cooling, very inexpensively, over relatively long time periods and to methods for making such devices.

BACKGROUND OF THE INVENTION

There are, of course, many ways to keep beverages cold ranging from simply packing the beverages in crushed ice to sophisticated coolers with temperature control features.

Examples of some patented devices in this field which are of relevance to the present invention include those disclosed in the following U.S. Pat. Nos. 415,980 (Sachs); 662,541 (Miskololzy); 2,648,954 (Wheeler et al); 2,979,227 (Norton et al); 4,295,345 (Atkinson); and 4,554,798 (D'Amour et al).

Briefly considering these patents, the D'Amour et al patent discloses a bottle cooling device which is made of a plastic material filled with a refrigerant. The unit is frozen and placed on the necks of the bottles to be kept cool. The Norton et al patent discloses a container for keeping a six-pack of bottled beverages cold. Crushed ice is placed around the bottles in the container. The Atkinson patent discloses a cooling container for keeping cans cold including a top section having a slow warming cooling gel contained therein. The Wheeler et al patent discloses a refrigerated carton including circular compartments. Dry ice is placed in the partitions between the compartments. The Sachs patent discloses a portable cooler for drinking glasses including cone-shaped partitions for receiving the bottles to be cooled. The Miskoloczy patent discloses a frozen container for keeping beverages cold.

A continuing problem with simple devices for providing cooling of beverages, i.e., those that use ice, is that the ice melts relatively rapidly particularly when in cubed or crushed form. Further, cooling devices which require a separate permanent container for the ice tend to be relatively expensive and impractical for some uses. For example, the cost of such devices would preclude a grocery store or convenience store from giving the device away to customers for use in cooling beverages purchased at the store.

SUMMARY OF THE INVENTION

In accordance with one aspect of the invention a cooling device is provided which is both simple and inexpensive and which overcomes the basic problems with prior art cooling methods and devices of comparable cost. Broadly speaking, the cooling device of the invention comprises a slab-like member or "tray"

formed solely of ice, on which the beverage containers to be cooled are received. Preferably, this "tray" is used with a simple receptacle or container such as a plastic bag, and with this arrangement, highly efficient cooling of the beverages can be effected over long periods of time without the mess and inefficiency associated with crushed ice or cube ice.

In a preferred embodiment, the overall cooling assembly includes an insulating member which is located beneath the ice "tray" for insulating the "tray" from its warmer surroundings. Advantageously, this insulating member comprises a plastic or paperboard card which can be perforated to permit melted ice to pass therethrough.

The insulating member advantageously includes means for affixing the insulating member to the ice "tray". In an important embodiment, this insulating member comprises an elevating member which elevates the ice above the bottom of the plastic bag or like receptacle and thereby creates space in which water from the melting ice can collect. This elevating member can take a number of different forms and, in one advantageous embodiment, comprises a corrugated member fabricated of plastic or the like and, in another, comprises a base sheet including a plurality of downwardly depending legs.

Preferably, the ice "tray " includes a plurality of apertures or recesses therein in which the beverage containers are received, so that, for example, a package of six containers can be readily supported thereby. Advantageously, these recesses are provided in a base portion of the device and drain holes are provided in this base portion to permit melted ice to drain away.

It will be appreciated that the cooling device of the invention, being in whole (solid) form, provides sustained cooling over extended periods, particularly as compared with crushed or cubed ice while at the same time eliminates the need for rigid permanent containers associated with cooling devices of the prior art. The cooling device can be readily manufactured and, in accordance with a further aspect of the invention, a method for easily and rapidly making the device is provided. As will be appreciated, the extremely low cost of manufacture is a major advantage over the prior art and, for example, enables the device to be even given away as part of a promotional or marketing scheme in selling beverages.

In accordance with a further aspect of the invention, a method is provided for producing a cooling receptacle for plural packaged beverage containers, wherein the method comprises the steps of: disposing the bottom of a bag in a mold; inserting into the bag a holding device comprising a plurality of beverage container gripping or holding loops supported by support means; adding water or another refrigerant to the bag to a level such that the gripping loops of the device extend above the water level while at least a portion of the support means is below the water level; freezing the water within the bag so as to form a slab of ice within the bag with the support means embedded or encapsulated therein; and removing the mold from the bag. The resultant product is a cooling receptacle comprising a slab of ice disposed within a bag incorporating projecting gripping loops for holding the beverage containers in contact with the surface of the ice slab. It will be appreciated that the steps prior to the freezing step can be performed in basically any order and that, for example, water can be added to the bag prior to disposing the bag in the mold and the holding device can be inserted in the bag after the water is added to the bag.

According to a related aspect of the invention, a cooling assembly is provided for cooling the beverage containers of a multi-container package, the assembly comprising: a flexible, waterproof bag or other receptacle; a molded slab of ice located at the bottom of the receptacle and including a generally planar upper surface; and a holding device comprising a plurality of gripping loops for gripping the beverage containers and holding the beverage containers in contact with the upper surface of the slab of ice, and a support or anchoring means, embedded with the slab of ice and connected to the gripping loops, for connecting said gripping loops to said slab of ice while supporting the gripping loops in spaced relationship to the upper surface of the slab of ice. In a preferred embodiment, the support means comprises a plurality of downwardly depending support legs, and, advantageously, the support legs each include a support pad at the bottom thereon.

In accordance with yet another aspect of the invention, a cooling device is provided for cooling beverage containers of a multi-container package of the type wherein the containers of the package are secured together as a package at the tops thereof in two rows and wherein the rows of beverage containers can be deflected away from each other to at least partially collapse or flatten out the package without releasing the containers from the package, the cooling device consisting solely of a shaped slab of ice including an upper surface comprising first and second inclined generally planar areas which slant downwardly away from each other form a raised central portion. These two areas each include part-cylindrical recesses therein in which the sides of the beverage containers of a partially flattened out package can be received so that the ice forming the recesses as directly engages and supports the containers of the package and provides cooling thereof.

In a preferred embodiment six recesses are provided and the recesses are arranged in two rows of three recesses in order to accommodate a conventional "six-pack".

In a further preferred embodiment of the invention, an open support tray is provided in which the slab of ice is received, the tray including holding means for holding the beverage containers in place on the slab of ice. The holding means advantageously comprises foldable portions of the tray which are, in use, folded over the bottom ends of the beverage containers. Preferably, the foldable portions of the tray comprise a plurality of foldable tabs individual to the containers.

Other features and advantages of the invention will be set forth in, or apparent from, the detailed description of a preferred embodiment which follows.

DESCRIPTION OF THE PREFERRED EMBODIMENTS

Figure 1:
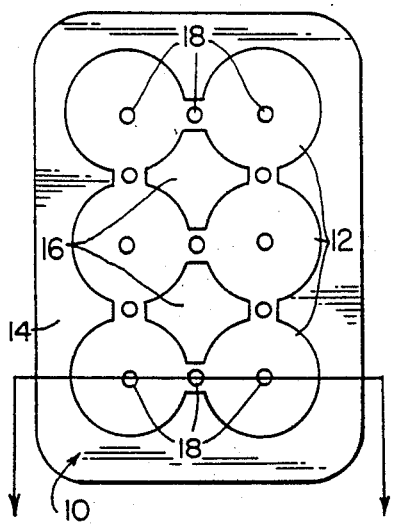
FIG. 1 is a plan view of a preferred embodiment of the cooling device or tray of the invention.
Figure 2:
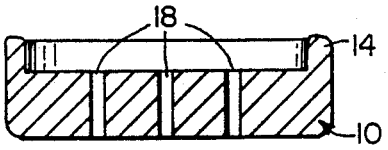
FIG. 2 is a cross section of the device of FIG. 1, taken generally along lines II—II of that figure.

Referring to FIGS. 1 and 2, a cooling device in accordance with a preferred embodiment of the invention is shown. As discussed above, the basic cooling device, which is generally denoted 10, consists solely of a slab-like, planar member of ice in the nature of a cooling tray. In the preferred embodiment illustrated in FIGS. 1 and 2, the device 10 is generally rectangular in shape, with rounded corners, as viewed in plan, and includes a plurality of recesses 12 therein which are shaped to receive the bottoms of the beverage containers so that an upstanding rim 14, which extends around the edge of the ice slab 10, and central upstanding portions 16, remain. Drain holes 18 are also formed in the slab 10 to permit water formed when the ice melts to drain through the bottom of the slab 10.

Figure 3:
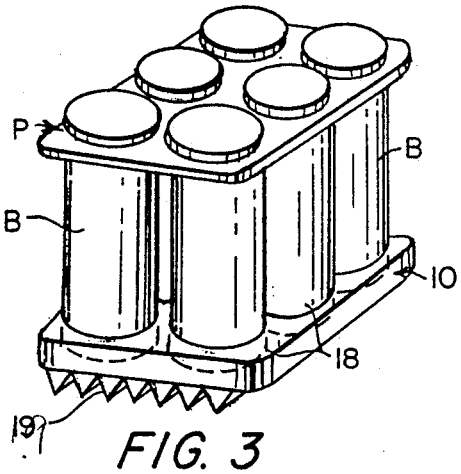
FIG. 3 is a perspective view of the cooling device of the invention, with a package of beverage containers supported thereon.

As illustrated in FIG. 3, in the use of the device of the invention, a package of beverage containers, denoted B, e.g., a six-pack of beer, is received on ice slab 10, with the bottom of the containers being received in apertures 18.

As illustrated, the overall cooling assembly also includes an insulating member 19, preferably made of corrugated plastic, on which slab 10 rests. Insulating member 19 insulates slab 10 from the ground on which the slab rests and, in this embodiment, constitutes an elevating member or device which elevates slab 10 and defines a space therebeneath in which water from the melted ice slab can collect.

Figure 4:
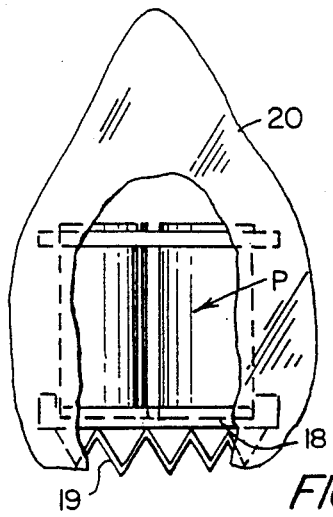
FIG. 4 is a side elevational view, partially broken away, of a combination of a cooling device and receptacle therefor, in accordance with a further aspect of the invention.

In a preferred embodiment illustrated in FIG. 4, the ice slab 10 and the package B supported for cooling on ice slab 10, are both disposed in a flexible, water resistance receptacle or container 20, preferably in the form of a plastic bag, which will retain any melted ice from the ice slab 10. This important embodiment also includes an insulating member 19 disposed between the bottom of slab 10 and the bottom of bag 20.

Figure 5:
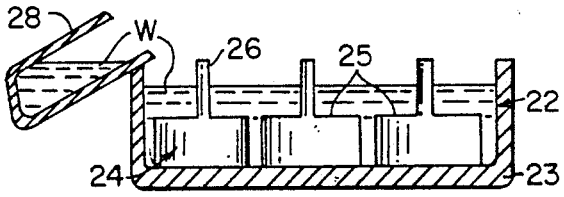
FIG. 5 is a side elevation view of a mold used in making a preferred embodiment of the cooling device of the invention and illustrates a step in the process of making the device.

Referring to FIG. 5, a mold 22 is shown which, in accordance with a further aspect of the invention, is used in making the cooling device of FIGS. 1 and 2. The mold 22 includes an outside container 23 and an integral inner form 24 which includes a six upstanding cylindrical mold sections 25 that are the reciprocal, in shape and arrangement, of the apertures 12 in the cooling device 10. In addition, a plurality of upstanding mold fingers 26 extend upwardly above the upper surfaces of mold sections 25. There are nine fingers 26 in the embodiment under consideration, corresponding to the nine drain apertures 18 in the cooling device 10. As illustrated, in order to form a cooling device 10, water, denoted W, is poured from a container 28 into form 22 to a sufficient depth to provide the desired thickness for the base of the device 10. The fingers 26 extend above this level so that the drain apertures formed thereby extend through the thickness of the device. Thus, when the mold is subjected to temperatures that cause the water W to freeze, the cooling device 10 is thus formed in ice and is ready for use upon being released from the mold 22.

Figure 6:
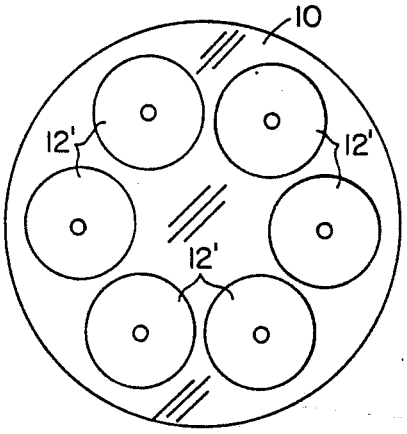
FIG. 6 is a plan view of a further embodiment of the invention.
Figure 7:
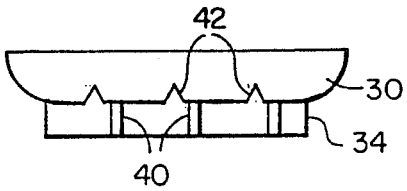
FIGS. 7 and 8 are side elevational views of two further embodiments of the invention.
Figure 8:
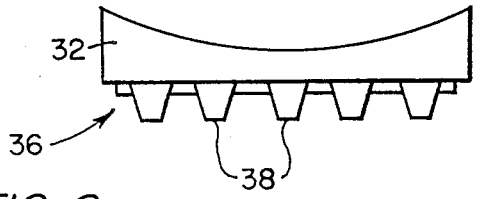

It will be appreciated that the cooling device 10 of the invention can take a number of different forms and the shape of the cooling device can vary both as viewed in plan and in section. For example, as shown in FIG. 6, a cooling device, denoted 10', is provided which is circular in shape as viewed in plan, with the beverage container receiving apertures 12' being arranged in a circle and including central drain holes 18'. Further, although it is preferred that the cooling device include beverage container receiving apertures, the upper surface can be flat, as shown in FIG. 7 for device 30, or concave, as shown in FIG. 8 for device 32. In addition, insulating member 19 can also take a number of different forms including, as shown in FIG. 7, a simple plastic or paper card 34 (which does not provide "elevation" in the sense discussed above) or a base member 36 including a plurality of downwardly depending hollow "legs" 38, which provide elevation and which permit drainage. In a further, non-illustrated example, a bowed or arched member having an aperture or apertures therein could be used to provide insulation and elevation. As illustrated, card 34 can include perforations 40 therein which assist in drainage, as well as adhesion or attachment means 42 which serve to secure the card 34 to the slab 30. In FIG. 7, these attachment means 40 take the form of protrusions or teeth, although a number of different embodiments, including connecting side portions, are, of course, possible. It will also be understood that there can be many variations and modifications in the basic embodiment shown in FIG. 1, and that, for example, the central portions 16 can be eliminated, the "wall" of ice defining apertures 18 can be discontinuous and can take a number of different forms and the overall outside shape of the base portion and/or of the apertures can be different.

Figure 9:
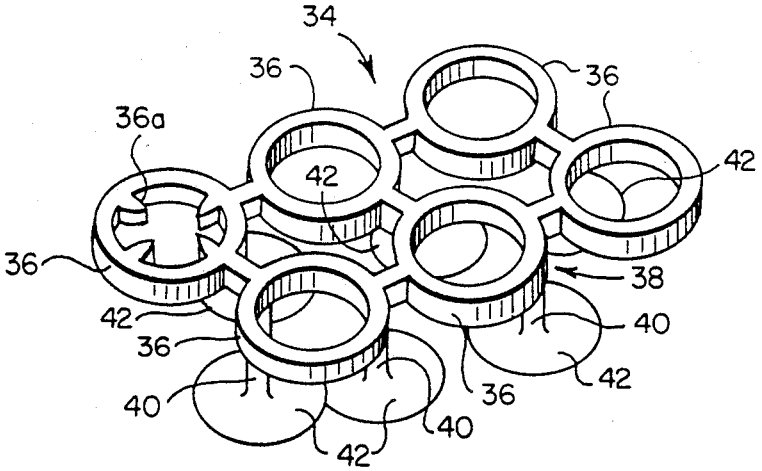
FIG. 9 is a perspective of a preferred embodiment of a beverage container holding or gripping device employed in a further embodiment of the invention.

Referring to FIG. 9, a device used in a further embodiment of the invention is shown. The device, which is generally denoted 34, comprises six rings 36 adapted to engage and hold the cans or bottles of a "six pack" of beverages. The rings 36 are preferably fabricated of plastic or the like and are arranged in three rows of two, as illustrated. The rings 36 are joined together at tangent points and may include gripping or holding members such as vanes **36*a*** or inwardly projecting nipples (not shown) or corrugations (not shown) or the like to enhance gripping and holding of the beverage containers.

Device 34 further includes a support portion 38 comprising a plurality of downwardly projecting legs 40 having pads 42 or the like at the bottom thereof for supporting rings 36 in an upright manner and for serving a further purpose described below. It will be understood from the description which follows that the support portion is not limited to the illustrated embodiment and can take a number of different forms.

Figure 10:
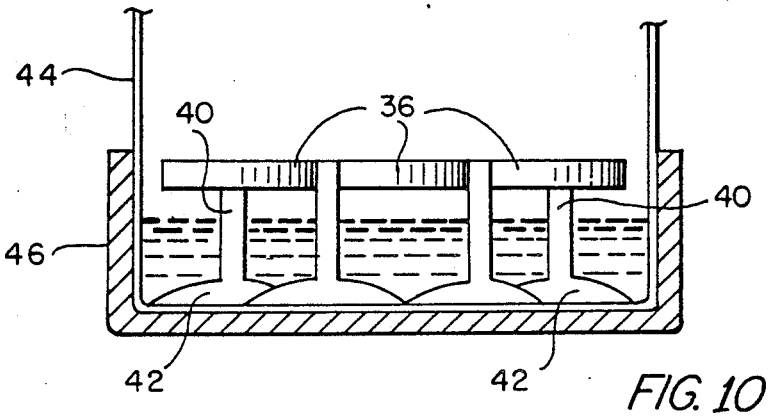
FIG. 10 is a cross sectional view of an assembly including a mold and a receptacle supported within the mold, with the device of FIG. 9 contained therein.

Referring to FIG. 10, holding device 34 is shown in use, disposed within a receptacle or bag 44 which itself is received within an outer mold 46. Receptacle 44 can take a number of forms although an ordinary plastic bag is preferred. Similarly, mold 46 can take a number of different forms but preferably comprises a simple rectangular box or tray of dimensions similar to but somewhat larger than those of the six pack of beverages, as in the embodiments discussed above. As discussed below, water or another refrigerant is poured into the bag 44 while disposed in mold 46 to a level below rings 36 of holding device 34 and is frozen so that legs 40 and feet or pads 42 are encapsulated therein, with the resulting product being a frozen slab or flat block of ice with gripping rings 36 projecting from the upper surface thereof so as to grip and hold the beverage containers against the surface of the ice.

Figure 11:
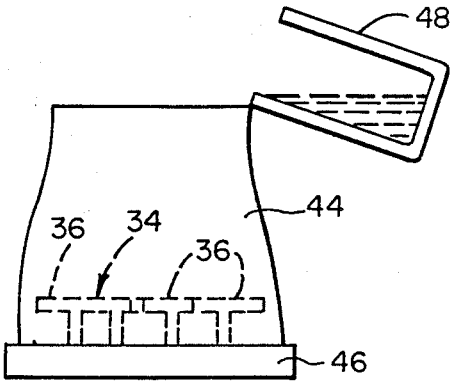
FIGS. 11 and 12 are schematic representations of two steps of a method in accordance with a preferred embodiment of the invention using the assembly of FIG. 10.
Figure 12:
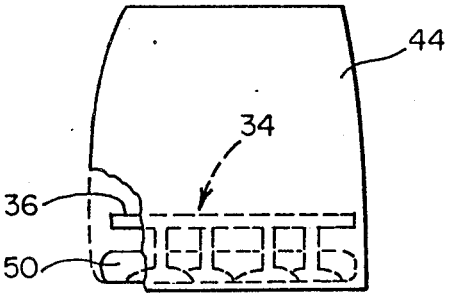

Although the method in accordance with this aspect of the invention should be evident from the foregoing, referring to FIGS. 11 and 12, the bottom of a bag 44 is placed in mold 46 as shown in FIG. 11 and a refrigerant, preferably water, is poured, from a container 48, into the bag 44, or is supplied thereto from another source such as a faucet or hose, so that a body of the refrigerant is provided in the bottom of bag 44 in the shape of the mold 46. As discussed above in connection with FIG. 10, the level of the refrigerant is controlled so that loops 36 will be exposed, i.e., will extend above the level of the water. The gripping device 34 is then inserted into the bag 44 although it will be appreciated that the device 34 can be inserted before the pouring of the refrigerant and the refrigerant can be poured into the bag 44 before the bag 44 is placed into the mold 46. In any event, as a next step, with device 34 in place within the bag 44 in the mold 46, and with the refrigerant poured into the bag 44, the refrigerant is caused to freeze so that a slab or block of ice 50 is formed in bag 44 and so that loops or rings 36 of holding device 34 project from slab 50 so as to enable the beverage containers of a "six-pack" to be gripped and held thereby in contact with the slab of ice 50.

Figure 13:
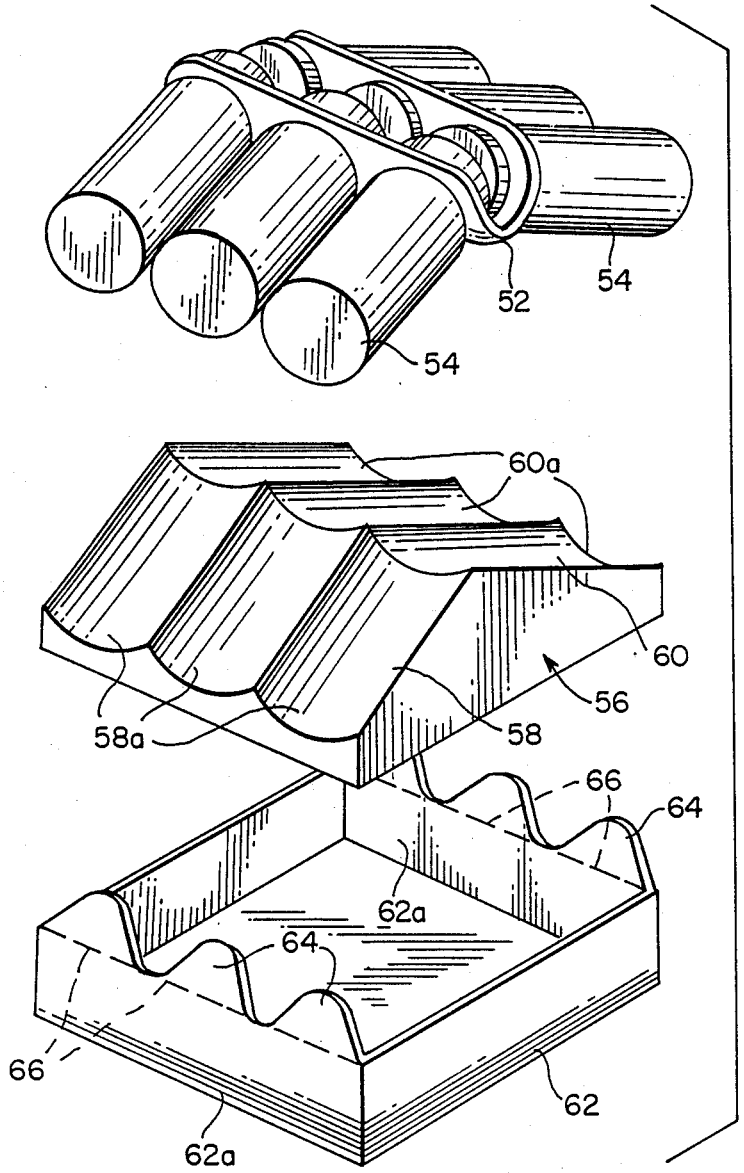
FIG. 13 is an exploded perspective view of a cooling arrangement in accordance with a further embodiment of the invention.
Figure 14:
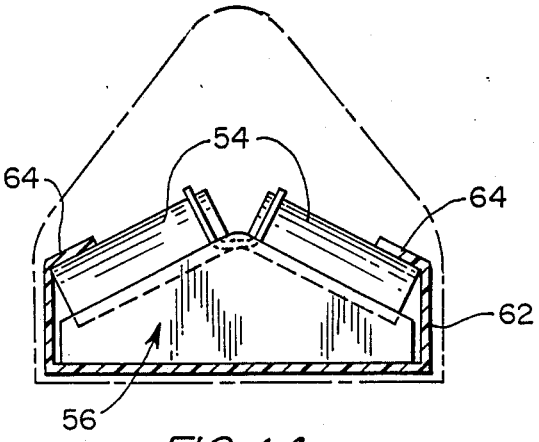
FIG. 14 is an end elevational view, partially in cross section, of the cooling arrangement of FIG. 13.
Figure 15:
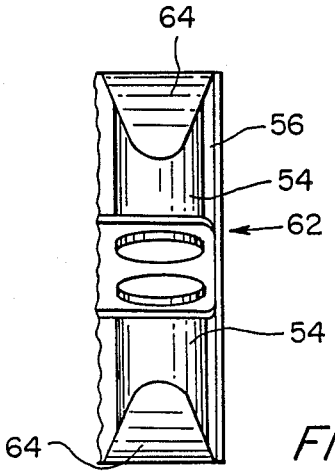
FIG. 15 is a partially broken away, top plan view of the cooling arrangement of FIG. 13.

Referring to FIGS. 13 to 15, a further embodiment of the invention is shown. This embodiment is adapted for use with a conventional "six-pack" of beverage containers wherein a beverage container holder, which is made of plastic or the like and which is denoted 52 in FIG. 3, is used to secure together the tops of the beverage containers, denoted 54. In the exemplary embodiment illustrated, the holder 52 defines or forms six openings arranged in two rows and is, as is characteristic of conventional holders of this type, flexible enough to permit the two rows of containers 54 to be deflected or bent away from each other in the manner shown so as to provide a partially flattened or collapsed package.

The cooling device of this embodiment of the invention, which is generally denoted 56, basically comprises a shaped slab of ice in which the upper surface thereof is divided into two oppositely inclined roughly planar areas 58 and 60 which slant down and away from each other from a central region or peak 62. As illustrated, each of the inclined surface areas 58 and 60 includes three semi-cylindrical recesses or indentations therein, denoted **58*a* and 60*a* respectively, arranged in side-byside relationship so as to receive the beverage containers 54 therein when the containers are in a collapsed or flattened condition, as indicated in FIG. 3. It will be appreciated that with the beverage containers 54 so supported on the "bed of ice" provided by the shaped ice slab 56**, the beverage containers are rapidly cooled and/or maintained in a cooled state by the ice surface in contact therewith.

In a preferred form of this embodiment, the overall device also includes a tray 62, preferably made of cardboard, plastic or the like, in which the shaped ice slab 56 is received. As illustrated, tray 62 basically comprises an open box which includes one pair of side walls 62*a* having three separate upwardly extending portions (i.e., peaked portions) 64 each of which, in use, is positioned opposite the bottom of a respective one of the beverage containers 54. The peaked portions 64 define "tabs" which can be folded along fold lines 66 over the ends of the beverage cans 54 as shown in FIGS. 14 and 15. This provides additional holding of cans 54. As in the other embodiments described above, a bag, indicated at 68 in dashed lines in FIG. 14, can be used to hold the beverage containers 54 received on the shaped ice slab 56 supported within tray 62.

Although the present invention has been described relative the exemplary embodiments thereof, it will be understood by those skilled in the art that variations and modifications can be effected in these exemplary embodiments without departing from the scope and spirit of the invention.

What is claimed:

1. A cooling device for providing cooling of beverage containers of a multi-container package of the type wherein the containers of the package are secured together as a package at the tops thereof in two rows and wherein the rows of beverage containers can be deflected away from each other to at least partially flatten out the package without releasing the containers from the package, said cooling device consisting solely of a shaped slab of ice including an upper surface comprising first and second inclined generally planar areas which slant downwardly away from each other from a raised central region, said areas each including part-cylindrical recesses therein, in which the sides of the beverage containers of a partially flattened out package can be received, so that the ice-formed said recesses directly engages and supports the containers of the package and provides cooling thereof.

2. A device for providing cooling of beverage containers as claimed in claim 1, wherein six said recesses are provided and wherein said recesses are arranged in two rows of three recesses.

3. A cooling assembly for providing cooling of beverage containers of a multi-container package of the type wherein the containers of the package are secured together as a package at the tops thereof in two rows and wherein the rows of beverage containers can be deflected away from each other to at least partially flatten out the package without releasing the containers from the package, said cooling assembly comprising a cooling device consisting solely of a shaped slab of ice including an upper surface comprising first and second inclined generally planar areas which slant downwardly away from each other, from a raised central region, said areas each including part-cylindrical recesses therein, in which the sides of the beverage containers of a partially flattened out package can be received, so that the ice forming said recesses directly engages and supports the containers of the package and provides cooling thereof, and an open tray in which said slab of ice is received, said tray including holding means for holding said beverage containers in place on said slab of ice.

4. A device for providing cooling of beverage containers as claimed in claim 3, wherein six said recesses are provided and wherein said recesses are arranged in two rows of three recesses.

5. A device for providing cooling of beverage containers as claimed in claim 3 wherein said holding means comprise foldable portions of said tray which are, in use, folded over the bottom ends of said beverage containers.

6. A device for providing cooling of beverage containers as claimed in claim 3 wherein said foldable portions of said tray comprise a plurality of foldable tabs individual to said containers.

* * * * *